United States Patent [19]

Blachetta et al.

[11] Patent Number: 4,575,420

[45] Date of Patent: Mar. 11, 1986

[54] BEATER-TYPE POWER SIEVE WITH FULL SPRING MOUNTING

[75] Inventors: Wolfram Blachetta, Cologne; Horst Peterling, Remscheid, both of Fed. Rep. of Germany

[73] Assignee: "RHEWUM" Rheinische Werkzeug- und Maschinenfabrik GmbH, Remscheid, Fed. Rep. of Germany

[21] Appl. No.: 607,205

[22] Filed: May 4, 1984

[30] Foreign Application Priority Data

May 4, 1983 [DE] Fed. Rep. of Germany ... 8313148[U]
Aug. 20, 1983 [DE] Fed. Rep. of Germany ..... 3330196

[51] Int. Cl.[4] ..... B07B 1/34

[52] U.S. Cl. ..... 209/322; 209/347; 209/382; 209/365 R

[58] Field of Search ..... 209/315, 365 A, 381, 209/365 R, 366.5, 413, 343, 342, 344, 379, 325, 389, 382, 347, 330, 322, 320, 328; 198/766, 770; 267/158, 159, 160, 40, 39, 42, 36 R, 47

[56] References Cited

U.S. PATENT DOCUMENTS

| | | | |
|---|---|---|---|
| 270,001 | 1/1883 | Best | 209/365.2 |
| 819,177 | 5/1906 | Selle | 209/365.2 |
| 1,353,546 | 9/1920 | Sturtevant | 209/347 |
| 1,380,289 | 5/1921 | Childers | 209/330 |
| 1,705,619 | 3/1929 | Kendall | 209/367 |
| 2,192,668 | 3/1940 | Strain | 209/347 |
| 2,334,368 | 11/1943 | Wolf | 209/367 |
| 4,169,788 | 10/1979 | Grunbaum | 209/365.1 |
| 4,469,592 | 9/1984 | Krause et al. | 209/382 |

FOREIGN PATENT DOCUMENTS

| | | |
|---|---|---|
| 2133187 | 8/1979 | Fed. Rep. of Germany . |
| 2016199 | 2/1982 | Fed. Rep. of Germany . |

*Primary Examiner*—Frank W. Lutter
*Assistant Examiner*—Wm. Bond
*Attorney, Agent, or Firm*—Karl F. Ross; Herbert Dubno

[57] ABSTRACT

A power sieve has a generally planar and longitudinally extending frame having upstream and downstream ends and a pair of laterally spaced side members extending longitudinally between the ends, a generally planar screen spanned longitudinally within the frame, and a plurality of longitudinally spaced and substantially parallel beater beams underneath the screen and having beam ends juxtaposed with the frame side members. Respective horizontally extending leaf springs each have one end secured to the respective side member and another end secured to the respective beam end. Thus the beams can move generally vertically on the springs. Respective beater arms extending generally parallel to the screen from the beater beams have outer ends engageable with the underside of the screen. In addition, respective actuation arms extending radially from the beater beams have outer ends connected to a rigid longitudinally extending link connected in turn to a linear drive on the frame connected to the link for horizontally reciprocating the link and thereby simultaneously and synchronously pivotally oscillating the beater beams with the respective beater arms to hammer the outer ends of the beater arms against the screen. In this manner when the screen is inclined down from the one end and particulate material is loaded onto the screen at this end the particulate material migrates down along the screen to the other end with the smaller fractions falling through the screen.

10 Claims, 2 Drawing Figures

BEATER-TYPE POWER SIEVE WITH FULL SPRING MOUNTING

FIELD OF THE INVENTION

The present invention relates to a power sieve. More particularly this invention concerns an industrial type sieve used for grading gravel, ore, or the like.

BACKGROUND OF THE INVENTION

A vibratory power screen normally has a generally planar and longitudinally extending frame having upstream and downstream ends and a pair of laterally spaced side members extending longitudinally between the ends. A generally planar screen is spanned longitudinally within the frame normally between its ends. The entire frame is tilted down from the upstream to the downstream end. Thus when particulate material is loaded onto the screen at the upstream end the particulate material migrates down along the screen to the downstream end with the smaller fractions falling through the screen.

The screen can be vibrated as described in commonly owned U.S. Pat. No. 4,319,993 wherein drive means is provided which includes a pair of drive motors fixed to the central member of the frame and respective eccentrics carried by the motors for limitedly displacing the frame and screen relative to the support. One of the motors is mounted on the high end below the plane of the screen and the other of the motors on the low end above the plane of the screen. In this case the frame is mounted, normally by suspension from stiff hangers, for limited displacement relative to a fixed support. Thus the entire frame and screen are shaken to sieve the material.

It is also known from German patent document No. 2,016,199 to provide the frame wih a plurality of longitudinally spaced and substantially parallel beater shafts underneath the screen. Respective beater arms extending generally parallel to the screen from the beater shafts have outer ends engageable with the underside of the screen. Respective motor/transmission drives are provided to oscillate the shafts and hammer the ends against the mesh, thereby vibrating the charge thereon. These multiple drive motors make the equipment quite expensive and hard to control.

Accordingly, in German patent document No. 2,133,187 a system is described wherein respective actuation arms extending radially from the beater shafts have outer ends all pivoted to a stiff longitudinally extending link. Drive means on the frame connected to the link simultaneously and synchronously pivotally oscillates the beater shafts with the respective beater arms to hammer the outer ends of the beater arms against the screen. In such an arrangement the frame need not be displaceable relative to a fixed support and a single drive can be used, invariably a crank arrangement on the rotary output of a motor/transmission unit. Although such an arrangement constitutes a considerable simplification and reduction in expensive parts, it substantially limits the adjustability of the system, as the stroke of the link is fixed and the frequency and force of the hammering on the bottom of the mesh is not readily controlled.

In copending application Ser. No. 406,955 filed Aug. 10 1982 (now U.S. Pat. No. 4,469,592) a system is described which is of the above-described general type, but which is provided with respective pivot plates each having one end rotatably supporting a respective end of one of the shafts and another end pivoted on a respective one of the side members at a respective adjustment axis for angular movement of said pivot plates with the respective shafts about the respective adjustment axes. The adjustment axes extend substantially parallel to one another transversely of the frame underneath the screen and are axially alignable with the outer ends of the respective actuation arms. Respective locking means can arrest pivotal movement of the pivot plates with the respective beater arms in any of a multiplicity of positions angularly offset relative to the alignment of the outer end of the respective actuating arm and the respective adjustment axis. With this system it is therefore possible to accurately adjust the positions of the beaters, for perfectly uniform beating action over the entire screen. This adjustment is, nonetheless, quite laborious as each beater must be positioned individually.

A common defect of all these systems is that the various pivot joints all require frequent servicing and attention. They are subject to considerable wear in the invariably dusty surrounding of the sieve, and therefore require periodic replacement even if properly maintained.

OBJECTS OF THE INVENTION

It is therefore an object of the present invention to provide an improved beater-type power sieve.

Another object is the provision of such a beater-type power sieve which overcomes the above-given disadvantages, that is which needs little servicing and which nontheless can be adjusted accurately.

SUMMARY OF THE INVENTION

A power sieve according to this invention has a generally planar and longitudinally extending frame having upstream and downstream ends and a pair of laterally spaced side members extending longitudinally between the ends, a generally planar screen spanned longitudinally within the frame, and a plurality of longitudinally spaced and substantially parallel beater beams underneath the screen and having beam ends juxtaposed with the frame side members. In accordance with this invention respective horizontally extending leaf springs each have one end secured to the respective side member and another end secured to the respective beam end. Thus the beams can move generally vertically on the springs. Respective beater arms extending generally parallel to the screen from the beater beams have outer ends engageable with the underside of the screen. In addition, respective actuation arms extending radially from the beater beams have outer ends connected to a rigid longitudinally extending link connected in turn to a linear drive on the frame connected to the link for horizontally reciprocating the link and thereby simultaneously and synchronously pivotally oscillating the beater beams with the respective beater arms to hammer the outer ends of the beater arms against the screen. In this manner when the screen is inclined down from the one end and particulate material is loaded onto the screen at this end the particulate material migrates down along the screen to the other end with the smaller fractions falling through the screen.

This use of a leaf spring for mounting the beater beams is extremely advantageous, as such springs permit only one degree of motion, perpendicular to their plane. Thus the springs can permit very free motion of the beater beams simply vertically or even twisting about their own axes, while effectively preventing any substantial displacement of these beams horizontally in any direction. (Actually the movement of something mounted in this manner on a leaf spring is basically pivotal about a center, but the angular stroke is so small in a power sieve with respect to the radius from the center of movement that to all effects and purposes the motion is straight-line tangential to this center.) With appropriate design it is possible for such leaf springs to have an enormously long service life, so long of course as their operating range is well below their elastic limit. The springs require no periodic lubrication and will not be subject to any appreciable weaar, even in the wear-aggravating surroundings of such a power sieve.

In accordance with another feature of this invention the leaf springs extend longitudinally and have downstream ends connected to the respective beams and upstream end connected to the respective side members. Furthermore, respective longitudinally extending leaf springs are connected between the link and the outer ends of the actuation arms. These further leaf springs each have a pair of ends secured to the link and a center secured to the respective arm outer end. One end of each of the link-arm leaf springs is fixed on the link and the other end thereof is longitudinally displaceable thereon. Such mounting once again transmits force extremely well, while permitting the exact relative movement necessary for proper beating of the screen. In fact the entire system will be self-balancing with the various spring forces together combining to give a uniform beating action, even without adjustment. The spring constant of a leaf spring is such that initially snugging the beater bars up on the screen uniformly is automatic, as the initial resistance of a leaf spring to deformation is very low.

The sieve of this invention also has a plurality of vertical links having lower ends secured to the link and upper ends secured to the frame. The vertical distance between the upper and lower ends of the vertical links is generally equal to the distance from the outer ends of the actuation arms to the respective beams. These vertical links are flexible but generally inextensible, normally also constituted as leaf springs.

The actuator of the present invention is of the standard solenoid type so that the frequency, length, and force of the stroke of the link can be controlled. This link can also ride on slide-type guides on the machine frame, and is connected via another longitudinally extending leaf spring to the armature of the solenoid to permit some relative up and down motion.

DESCRIPTION OF THE DRAWING

The above and other features and advantages will become more readily apparent from the following, in which.

SPECIFIC DESCRIPTION

Figure 1:
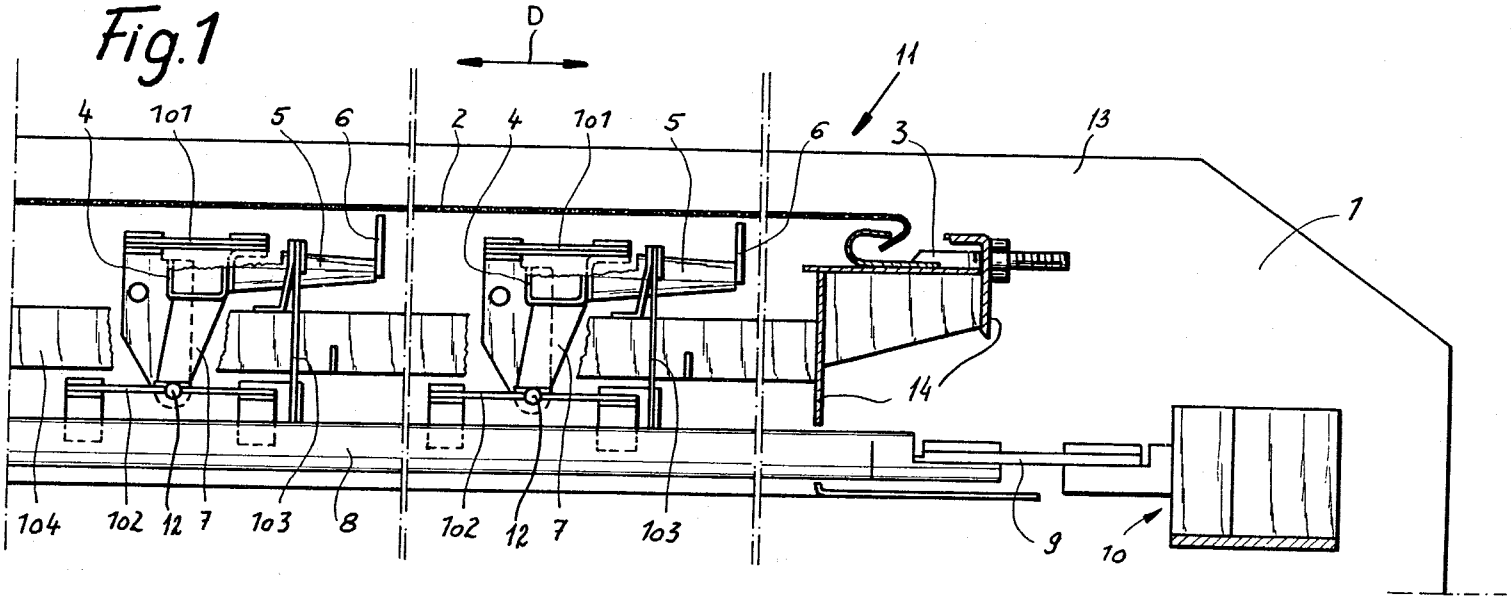
FIG. 1 is a longitudinal section through the power seive according to this invention.
Figure 2:
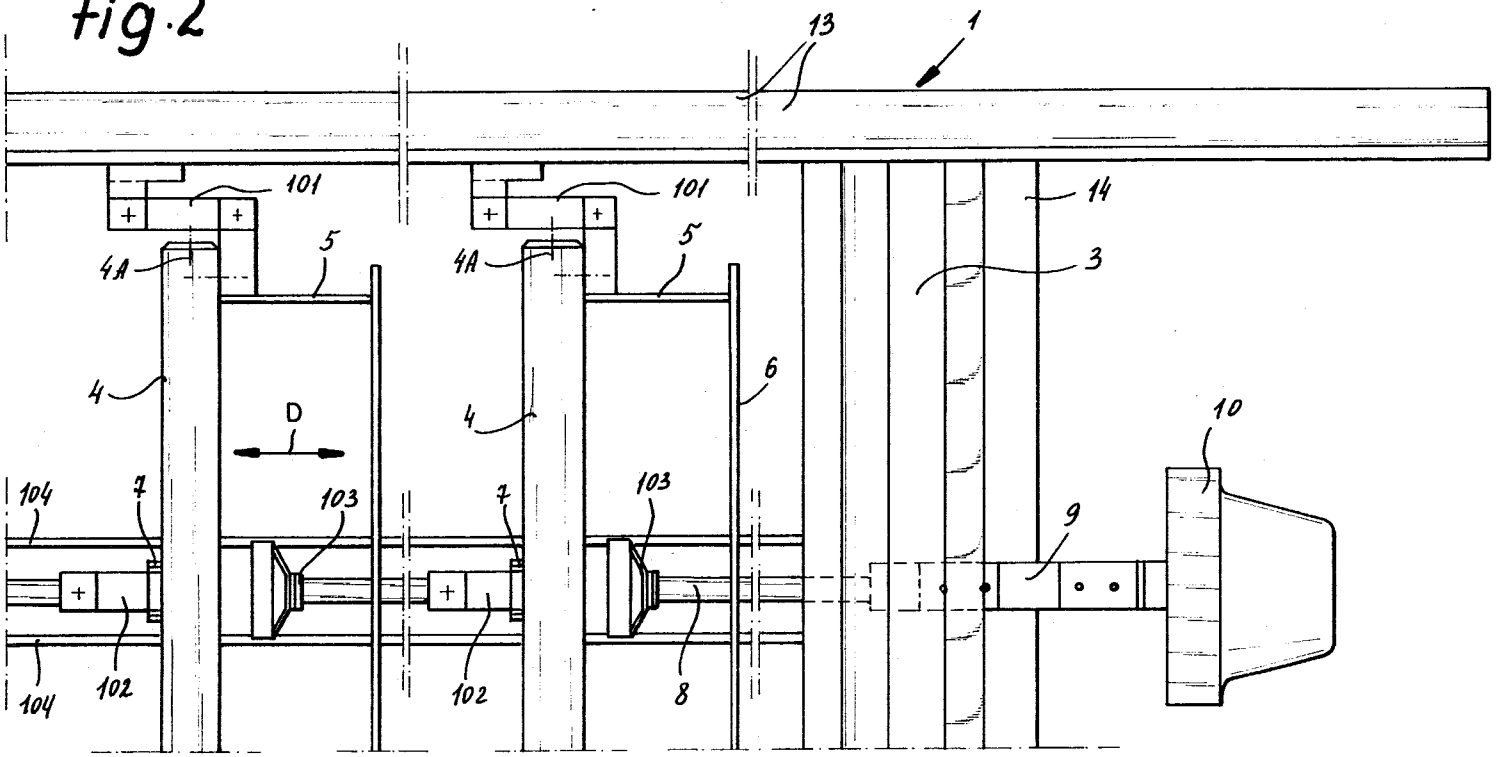
FIG. 2 is a top view of the sieve of FIG. 1.

As seen in FIGS. 1 and 2 a sieve has a horizontal and rectangular frame 1 elongated in a horizontal direction D and having longitudinally and horizontally extending side members 13 and transverse and horizontal end members 14 extending therebetween. A screen 2 is stretched longitudinally in the frame 1 between an upstream input location 11 at the one end member 14 and a downstream output location spaced therefrom to the left as seen in the drawing and not shown here. In use the entire apparatus is tipped so that the output end is below the input end 11.

Several parallel and longitudinally equispaced beater beams 4 lie beneath the mesh 2 and extend transverse to the frame 1, that is crosswise of its here horizontal longitudinal direction D. Each of these beams 4 is tubular for maximum torsional rigidity and minimum weight and is suspended at each end on the downstream end of a leaf spring 101 extending in the direction D and having an upstream end secured to respective side member 13 of the frame 1. The beams 4 extend horizontally perpendicular to the direction D and these leaf springs 101 extend horizontally in the direction D, so that the beams 4 cannot move appreciably in any horizontal direction relative to the frame 1. On the other hand the beams 4 can move up and down, mainly arcuately about a center defined by the upstream end of the respective springs 101 and these beams 4 can also twist somewhat about their horizontal longitudinal axes 4A.

Each of the beams 4 carries a plurality of radially extending and axially aligned beater arms 5 extending upstream generally parallel to the longitudinal plane of the screen 2. Each set of arms 5 carries a transverse beater bar 6 engageable with the underside of the screen 2 at a location somewhat upstream of the respective shaft 4. In effect the downstream ends of the leaf springs 101 are connected to the beam 4 at the very bases of the arms 5, so that the beams 4 act as counterweights for the bars 6 and the system is fairly well balanced.

The beams 4 also have respective central pairs of downwardly extending actuation arms 7 which have lower outer ends pivoted at axles 12 carried centrally in respective leaf springs 102 extending horizontally in the direction D and having upstream and downstream ends fixed on a rigid drive link or beam 8 connected via a stiff but elastically deformable leaf-spring link 9 to a linear solenoid or actuator 10 at the upstream end of the frame 1. This link 8 is secured in turn to the lower ends of vertical leaf springs 103 whose upper ends are secured to longitudinally extending beams 104 fixed in the end members 14 of the frame 1 and extending horizontally in the direction D therein. Thus the link 8 can only move horizontally in the direction D, actually arcuately about a center generally at the upper end of a one of the springs 103.

With this arrangement the actuator 10 periodically pulls the link 8, assuming all the parts to be in the FIG. 1 position. This twists the assemblies each formed by a one of the beams 4 and the respective arms 5, 7, and beaters 6, to raise the beams 4 while pulling the axles 12 upstream. As soon as each beater 6 strikes the mesh 2 it will be urged, with the respective arms 5 and 7 and beam 4 downward, deforming the spring 102 downward, it being noted that the downstream end of these springs 102 is longitudinally slidable on the link 8. As a result a very smooth yet effective beating of the mesh is effected. The length and force of the actuation strokes can be varied steplessly, and the rate these strokes are delivered at can also be steplessly varied, so it is possible to control the sieve extremely accurately.

We claim:

1. A power sieve comprising:

a generally planar frame extending parallel to a predetermined generally horizontal longitudinal direction and having upstream and downstream longitudinally spaced ends and a pair of side members extending longitudinally between the ends and spaced apart transversely of the longitudinal direction;

a generally planar screen spanned longitudinally within the frame;

a plurality of longitudinally spaced, horizontally and transversely extending, and substantially parallel beater beams underneath the screen and each having transversely opposite beam ends juxtaposed with the frame side members;

respective longitudinally extending leaf springs extending substantially parallel with said screen in the predetermined longitudinal direction each having one longitudinal end secured to the respective side member underneath the screen and another longitudinal end secured to the respective beam end underneath the screen, whereby the beams can move generally vertically on the springs;

respective beater arms extending longitudinally and generally parallel to the screen from the beater beams and having outer ends engageable with the underside of the screen;

respective actuation arms extending at least generally vertically from the beater beams and having outer ends;

a rigid longitudinally extending link pivotably connected to the outer ends of the actuation arms; and drive means on the frame connected to the link for longitudinally reciprocating the link and thereby simultaneously and synchronously pivotally oscillating the beater beams with the respective beater arms to hammer the outer ends of the beater arms up against the screen, whereby when the screen is inclined down from the upstream frame end and particulate material is loaded onto the screen at this upstream end the particulate material migrates down along the screen to the downstream frame end with the smaller fractions falling through the screen.

2. The beater-type power sieve defined in claim 1, further comprising respective longitudinally extending leaf springs connected between the link and the outer ends of the actuation arms.

3. The beater-type power sieve defined in claim 2 wherein the leaf springs between the link and arm outer ends each have a pair of ends secured to the link and a center secured to the respective arm outer end.

4. The beater-type power sieve defined in claim 3 wherein one end of each of the link-arm leaf springs is fixed on the link and the other end thereof is longitudinally displaceable thereon.

5. The beater-type power sieve defined in claim 1, further comprising a plurality of vertical links having lower ends secured to the link and upper ends secured to the frame.

6. The beater-type power sieve defined in claim 5 wherein the vertical distance between the upper and lower ends of the vertical links is generally equal to the distance from the outer ends of the actuation arms to the respective beams.

7. The beater-type power sieve defined in claim 5 wherein the vertical links are flexible but generally inextensible.

8. The beater-type power sieve defined in claim 5 wherein the vertical links are leaf springs also.

9. The beater-type power sieve defined in claim 1 wherein the drive means is a solenoid carried on the frame.

10. The beater-type power sieve defined in claim 1 wherein the one ends of the leaf springs attached to the side members are downstream of the other spring ends, that is closer to the downstream frame end than these other spring ends.

* * * * *